US009209006B2

(12) United States Patent
Kalinitchenko

(10) Patent No.: US 9,209,006 B2
(45) Date of Patent: Dec. 8, 2015

(54) MASS SPECTROMETRY

(71) Applicant: Analytik Jena AG, Jena (DE)

(72) Inventor: Iouri Kalinitchenko, Berwick (AU)

( * ) Notice: Subject to any disclaimer, the term of this patent is extended or adjusted under 35 U.S.C. 154(b) by 0 days.

(21) Appl. No.: 14/355,808

(22) PCT Filed: Nov. 5, 2012

(86) PCT No.: PCT/AU2012/001357

§ 371 (c)(1),
(2) Date: May 1, 2014

(87) PCT Pub. No.: WO2013/063660

PCT Pub. Date: May 10, 2013

(65) Prior Publication Data

US 2014/0312243 A1 Oct. 23, 2014

(30) Foreign Application Priority Data

Nov. 3, 2011 (AU) ..... 2011904560

(51) Int. Cl.
*H01J 49/42* (2006.01)
*H01J 49/06* (2006.01)

(52) U.S. Cl.
CPC ..... *H01J 49/062* (2013.01); *H01J 49/063* (2013.01)

(58) Field of Classification Search
USPC ..... 250/281, 282, 283, 288
See application file for complete search history.

(56) References Cited

U.S. PATENT DOCUMENTS 6,153,880 A 11/2000 Russ et al.
8,779,353 B2 * 7/2014 Zanon et al. ..... 250/281
2003/0155496 A1 8/2003 Kalinitchenko
2003/0222213 A1 12/2003 Taniguchi
2004/0178342 A1 9/2004 Kernan et al.
2005/0167584 A1 * 8/2005 Kernan et al. ..... 250/290
2009/0218484 A1 9/2009 Javahery et al.
2009/0302216 A1 12/2009 Londry
2010/0301210 A1 12/2010 Bertsch et al.
2010/0308218 A1 * 12/2010 Wang ..... 250/292
2010/0320376 A1 12/2010 Makarov et al.
2011/0248162 A1 10/2011 Makarov et al.
2012/0223244 A1 * 9/2012 Welkie ..... 250/396 ML

FOREIGN PATENT DOCUMENTS

CN 101005002 A 7/2007
WO 2009037598 A2 3/2009

OTHER PUBLICATIONS

Makarov, Alexander et al., Performance Evaluation of a Hybrid Linear Ion Trap/Orbitrap Mass Spectrometer, Analytical Chemistry, Apr. 1, 2006, pp. 2113-2120, vol. 78, No. 7.

* cited by examiner

*Primary Examiner* — Nicole Ippolito
(74) *Attorney, Agent, or Firm* — Robic, LLP

(57) ABSTRACT

There is provided an ion guide arrangement comprising a guide assembly comprising a plurality of elongate members arranged so as to be spaced about a common axis. The elongate members are capable of being in electrical association with one another so as to guide a stream of ions along an intended pathway substantially aligned with the axis. The or each elongate member is shaped at or near an end of the ion guide assembly so as to define a region capable of receiving a quantity of ions, whereby the or each elongate member is so shaped so as the region converges substantially toward the axis.

21 Claims, 11 Drawing Sheets

MASS SPECTROMETRY

FIELD OF THE INVENTION

The present invention concerns improvements in or relating to mass spectrometry. More particularly, the invention relates to improvements to ion guide arrangements for use with mass spectrometry apparatus.

BACKGROUND OF THE INVENTION

In this specification, where a document, act or item of knowledge is referred to or discussed, this reference or discussion is not an admission that the document, act or item of knowledge or any combination thereof was at the priority date part of common general knowledge, or known to be relevant to an attempt to solve any problem with which this specification is concerned.

Mass spectrometers are specialist devices used to measure or analyse the mass-to-charge ratio of charged particles for the determination of the elemental composition of a sample or molecule containing the charged particles.

A number of different techniques are used for such measurement purposes. One form of mass spectrometry involves the use of an inductively coupled plasma (ICP) torch for generating a plasma field into which a sample to be measured or analysed is introduced. In this form, the plasma vaporises and ionizes the sample so that ions from the sample can be introduced to a mass spectrometer for measurement/analysis.

As the mass spectrometer requires a vacuum in which to operate, the extraction and transfer of ions from the plasma involves a fraction of the ions formed by the plasma passing through an aperture of approximately 1 mm in size provided in a sampler, and then through an aperture of approximately 0.4 mm in size provided in a skimmer (typically referred to as sampler and skimmer cones respectively).

A number of problems are known to exist with prior art mass spectrometer arrangements, which have been observed to reduce their measurement sensitivity.

Another problem with prior art arrangements is collisional scattering and poor ion mobility. Mass spectrometers normally operate in a residual gas atmosphere, where gas particles of collisional gases often collide with passing ions which divert or scatter the ions from their intended direction of travel. Collisions of this nature can result in reduced signal sensitivity. Some mass spectrometers utilise specific collisional/reactive cells (a pressurized atmosphere often arranged in conjunction with multi-pole ion guidance systems) to manipulate, control and/or filter the ion beam. In such cases, collisional scatter also becomes a problem where such collisional gases are held under pressure.

SUMMARY OF THE INVENTION

According to a first principal aspect of the present invention, there is provided an ion guide assembly having a plurality of elongate rods oriented about a common axis, the elongate rods capable of being in electrical association with one another so as to guide a stream of ions along an intended pathway substantially aligned with the common axis, each elongate rod having a cross-section modified along part of its length in a region adjacent the common axis.

Typically the cross-section so modified will face the common axis.

Preferably the modified cross-section is substantially uniform. In one embodiment, the modification is such that the cross-section is tapering. In another embodiment the modification is such that the cross-section presents a concavity or convexity (which faces towards the common axis). Other modifications to the cross-section of the rods are envisaged within the scope of the invention.

Typically inner faces of the rods are modified according to the invention.

The modified cross-section may result in convergence of the inner faces of the rods. Alternatively, the modification may result in divergence of the inner faces.

According to a second principal aspect of the present invention, there is provided an ion guide arrangement comprising:

an ion guide assembly comprising:

a plurality of elongate members arranged so as to be spaced about a common axis, each of the elongate members capable of being in electrical association with one another so as to guide a stream of ions along an intended pathway substantially aligned with the common axis, the or each elongate member shaped at or near an end of the ion guide assembly so as to, at least in part, define a region capable of receiving a quantity of ions, the or each elongate member being so shaped so that the region converges substantially toward the axis in a direction aligned substantially with the flow of ions along the pathway.

In one embodiment, the region is shaped so as to direct or focus a quantity ions received thereby toward the pathway. In this arrangement, the pathway is substantially concentric with the common axis.

In a preferred embodiment, the dimension of the region is larger at the end of the guide assembly where the ions are initially received, and smaller at an end opposite thereto. Thus, the region is orientated so that ions are received by the end having the larger dimension and flow toward the opposite end having the smaller dimension. In this arrangement, the end having a smaller dimension is arranged adjacent the beginning of the pathway along which the ions flow through the ion guide arrangement. Put another way, the dimension (for example the effective radius of the region) changes continuously as a function of distance along the common axis in the direction of the ion flow.

The ion guide arrangement may comprise an exit from which ions leave the arrangement. Preferably, this exit coincides with the termination of the intended pathway along which the ions flow.

Embodiments of the configuration are thought to allow the ions to accelerate toward the pathway and therefore allows for more efficient transport of the ions through the ion guide arrangement even if increased gas pressure is provided. Such arrangements are considered to have the effect of improving ion mobility through the mass spectrometry device thereby improving the signal intensity.

In one embodiment, the shape of the ends of the elongate members is such that the periphery of the region converges towards the common axis in a linear manner. Thus, portions of the elongate members which face inwards toward the common axis (interior facing portions) are shaped so as to define the periphery of the region. In one embodiment, the shape of the interior facing portions is such that the ends of the elongate members are tapered (longitudinally relative to the axial direction of the respective elongate member).

The convergence of the region towards the common axis may, however, be provided by way of a curvilinear shaping.

The shape of the elongate members may be in the form of a truncation or similar formation. Typically, the truncated shape provides a modified surface region at the ends of the elongate members which is substantially flat. It may be appreciated, however, that the modified surface region may be shaped so as to be concave or convex.

In the simplest embodiment, the elongate members are arranged so as to be parallel one another.

The elongate members may each be of uniform cross section along a substantial portion of their respective lengths. The cross section may be circular or of another convenient and appropriate shape.

In one embodiment, the iron guide arrangement comprises four metallic elongate members arranged substantially parallel one another.

The ion guide assembly may be held in position by a support assembly comprising one or more support members arranged so as to ensure the ion guide assembly is positioned appropriately relative to the surrounding components, such as those typical of mass spectrometer devices. The general configuration and supporting structure of the elongate members will be known in the art and further description is therefore not required, however, one advantage of the arrangement of the present invention is that customized supporting assemblies do not need to be designed or developed to accommodate inferior arrangements where the elongate members are each arranged in different orientations. The specific and individual shape of the elongate members defining the region which receives the ions allows for the elongate members to be held within existing or standard support assembly arrangements.

The material from which each of the elongate members is provided is selected so as the members may be arranged in electrical association with each other so that the flow of ions accords substantially along the intended pathway. In a manner that would be understood by the skilled person, the plurality of elongate rods may be arranged in electrical radio frequency (RF) and/or direct current (DC) association with one another as appropriate. In one form, a multi-phase arrangement is provided in which a first set of rods comprising two or more of the plurality of elongate rods are arranged in electrical communication with a first phase, and a second set of rods comprising another two or more of the plurality of elongate rods are arranged in electrical communication with another phase. It will be appreciated that the control of the electrical association of the members is complex and generally well known in the art, and need not be explored further hereafter.

In view of the above description, it will be appreciated that the ends of the elongate members are sufficiently shaped so that they define the periphery of the region within which the quantity of ions may be received and focused toward the pathway along which they are intended to travel. This has been found to have an advantageous effect of increasing the quality of the ion stream passing through the ion guide arrangement.

The common axis about which the elongate members are each arranged may be non-linear thereby allowing the region and the exit from which the ions leave the ion guide arrangement to be spatially distinct from one another. For example, in one embodiment, the region is arranged substantially concentric about a first axis, and the exit from the ion guide arrangement is arranged substantially concentric about a second axis.

Therefore, in a typical arrangement, the first and second axes may be arranged so as to be substantially concentric with one another. However, the first and second axes may be spatially distinct from one another. Therefore, it will be appreciated that the pathway along which the ions travel therealong may be non-linear, and, for the most part, comprise a portion or distance thereof which is substantially curvilinear in nature.

Preferably, the geometry and arrangement of the elongate members influences the shape of the pathway.

According to a third principal aspect of the present invention, there is provided an ion guide arrangement comprising:

an ion guide assembly comprising:

a plurality of elongate members arranged so as to be spaced about a common axis, the elongate members capable of being in electrical association with one another so as to guide a stream of ions along an intended pathway substantially aligned with the axis, the or each elongate member shaped at or near a first end of the ion guide assembly so as to define, at least in part, a first region capable of receiving a quantity of ions;

a second region defined, at least in part, by the elongate members at a second end of the ion guide assembly, opposite the first end, and from which the ions exit from the ion guide arrangement, the elongate members being arranged so as to define a pathway between the first and second regions;

the or each elongate member so shaped at the respective ends so as the first region substantially converges towards the axis, and the second region substantially diverges from the axis in a direction aligned substantially with the flow of ions along the pathway.

The first region may be arranged substantially similar to the region described with reference to the first aspect of the invention.

In some embodiments, the second region mirrors the shape of the first region. In this regard, the shape of the second region is such that an end from which ions exit the ion guide assembly is larger in dimension than an opposite end at which ions are received from the first region. Thus, the dimension (for example the effective radius of the second region) changes as a function of distance along the common axis in the direction of the ion flow. Without being bound by theory, it is considered (with the assistance of computer modeling) that embodiments of this nature are helpful when it is desired to promote or enhance the transport efficiency of the ion flow when exiting the ion guide arrangement. Accordingly, arrangements of this nature have been found to improve the mobility of ions throughout mass spectrometry devices thereby improving the signal intensity.

The first and second regions may be spatially distinct from each other.

The shape of the rods of the ion guide arrangements has been found to have the effect of repelling, as a result of the convergence of at least the first region, any by-product ions generated due to chemical physical reactions occurring within the collisional cell space (within the first region).

According to a further principal aspect of the present invention there is provided an ion guide assembly having a plurality of elongate rods oriented about a common axis, the elongate rods capable of being in electrical association with one another so as to guide a stream of ions along an intended pathway substantially aligned with the common axis, the inwardly facing surface of each elongate rod having been modified along part of its length relative to the intended ion pathway.

According to a further principal aspect of the present invention, there is provided a collisional cell comprising an ion guide assembly or ion guide arrangement according to any one of the embodiments of the above defined aspects of the present invention.

The collisional cell preferably comprises a housing within which the ion guide arrangement is housed. The housing is preferably arranged so as to be substantially airtight so that it may contain an atmosphere comprising one or more predetermined gases. Such gases may include, but are not to be limited to, one or more reaction or collision gases such as ammonia, methane, oxygen, nitrogen, argon, neon, krypton, xenon, helium or hydrogen, or mixtures of any two or more of them, for reacting with ions extracted from the plasma. It will be appreciated that the latter examples are by no means exhaustive and that many other gases, or combinations thereof, may be suitable for use in such collisional cells.

The housing may comprise a gas inlet through which the gases may be introduced into the collisional cell. The housing may also include an outlet through which the gases may be exhausted so as the internal atmosphere may be replenished.

The housing may comprise an ion inlet through which ions may be introduced into the first region. Furthermore, the housing may comprise an ion outlet from which the ions exit the collisional cell.

In one embodiment, the ion inlet and ion outlets of the housing each exist in the form of respective apertures formed in the housing. The ion inlet and ion outlet apertures are, in one form, provided on opposite walls of the housing and are concentric with one another.

For embodiments where the first and second regions are spatially distinct from one another, the ion inlet will be provided in the appropriate wall of the housing so that ions may be received by the first region, and the ion outlet will be provided so that the ions may pass from the second region and outward therethrough. Thus, the ion inlet will be generally concentric with the first region, and the ion outlet will be generally concentric with the second region.

According to another principal aspect of the present invention there is provided a mass spectrometer having an ion source for producing a directed ion beam along a desired pathway, detection means, and at least one ion guide assembly or ion guide arrangement according to any of the embodiments of the above defined aspects of the present invention.

According to another principal aspect of the present invention there is provided a mass spectrometer having an ion source for producing a directed ion beam along a desired pathway, detection means, and at least one collisional cell arrangement according to any one of the above described embodiments of the collisional cell aspect of the present invention.

According to yet another principal aspect of the present invention there is provided a method of modifying an existing ion guide arrangement so that the arrangement may provide an embodiment according to any one of the above defined aspects of the present invention.

BRIEF DESCRIPTION OF THE DRAWINGS

Embodiments of the invention will now be further explained and illustrated, by way of example only, with reference to any one ox more of the accompanying drawings in which.

DETAILED DESCRIPTION

Figure 1:
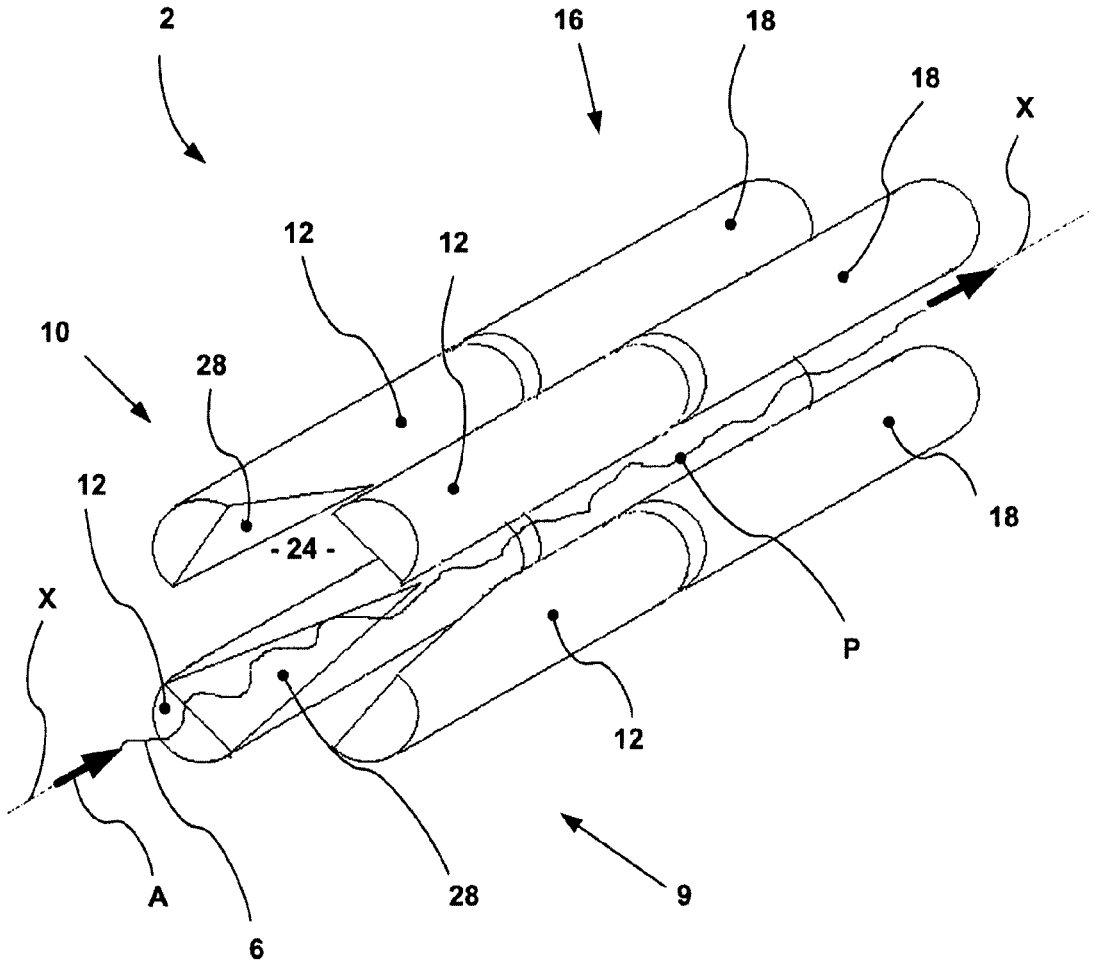
FIG. 1 shows a perspective view of an ion guide arrangement arranged in accordance with one embodiment of the present invention.

For brevity, embodiments of the arrangements of the present invention, and their use in a collisional cell, will be described with specific regard to inductively coupled mass spectrometry (ICP-MS) devices. However, it will be appreciated that such ion guide and collisional cell arrangements may be readily applied to any mass spectrometry instrumentation, including those having any type of collision atmosphere (including, but not limited to multi-pole collision or reaction cells) arrangements used for selective ion particle fragmentation, attenuation, reaction, collision scattering, manipulation, and redistribution with the purpose of mass-spectra modification.

The following mass spectrometry devices may benefit from the principles of the present invention: atmosphere pressure plasma ion source (low pressure or high pressure plasma ion source can be used) mass spectrometry such as ICP-MS, microwave plasma mass spectrometry (MP-MS) or glow discharge mass spectrometry (GD-MS) or optical plasma mass spectrometry (for example, laser induced plasma), gas chromotography mass spectrometry (GC-MS), liquid chromotography mass spectrometry (LC-MS), and ion chromotography mass spectrometry (IC-MS). Furthermore, other ion sources may include, without limitation, electron ionization (EI), direct analysis in real time (DART), desorption electro-spray (DESI), flowing atmospheric pressure afterglow (FAPA), low temperature plasma (LTP), dielectric barrier discharge (DBD), helium plasma ionization source (HPIS), desorption atmosphere pressure photo-ionization (DAPPI), and atmosphere or, ambient desorption ionization (ADI). The skilled reader will appreciate that the latter list is not intended to be exhaustive, as other developing areas of mass spectrometry may benefit from the principles of the present invention.

By way of brief explanation, for the case of ICP-MS devices, a 'Campargue' type configuration plasma sampling interface is often utilized to provide for the production and transfer of ions from a test sample to a mass spectrometer. An interface of this configuration generally consists of two electrically grounded components: a first component generally referred to as a sampler (or sampler cone), which is placed adjacent the plasma to serve as an inlet for receiving ions produced by the plasma; and, a second component commonly known as a skimmer (or skimmer cone), which is positioned downstream of the sampler so that ions pass there through en-route to the mass spectrometer. The skimmer generally includes an aperture through which the ions pass.

The purpose of the sampler and skimmer arrangement is to allow the ions to pass (via respective apertures) into a vacuum environment required for operation by the mass spectrometer. The vacuum is generally created and maintained by a multi stage pump arrangement in which the first stage attempts to remove most of the gas associated with the plasma. One or more further vacuum stages may be used to further rarify (that is reduce the pressure of) the atmosphere prior to the ions reaching the mass spectrometer.

In most systems, an ion optics or extraction lens arrangement is provided and positioned immediately downstream of the skimmer for extracting the ions from the plasma.

FIG. 1 shows one embodiment of an ion guide arrangement 2 comprising an ion guide assembly 10 having four elongate rods or members 12 arranged so as to be spaced about a common axis X. The rods 12 are selected such that they are capable of being arranged in electrical association with one another so as to guide a stream of ions (6) along an intended pathway P which is substantially aligned with the common axis X. Each rod 12 has a modified cross-section along part of its length.

In the embodiment shown, each rod 12 is shaped at or near an end 9 of the ion guide assembly 10 so as to define a region 24 capable of receiving a quantity of ions. Each rod 12 is shaped so as the region 24 converges substantially toward the common axis X in the direction of the ion flow A. It will be appreciated that the elongate members may be arranged differently from the embodiment shown in FIG. 1. For example, further embodiments of the rods 12 are shown in FIGS. 10A, 10B, 11A, and 11B (similar reference numerals are provided to ensure consistency with the present discussion).

With reference again to the embodiment shown in FIG. 1, the four rods 12 are arranged so as to be substantially parallel one another, and are of circular cross and uniform along their respective lengths. The rods 12 are of a metallic material of a nature that allows the rods to be capable of being arranged in electrical association with one another so that the flow of ions may be controlled so as to accord substantially along the desired pathway P.

In a manner that would be understood by the skilled person, the rods 12 may be arranged in electrical radio frequency (RF) and/or direct current (DC) association with one another as appropriate. In one form, a multi-phase arrangement can be provided in which a first set of rods (comprising two or more of rods 12) are arranged in electrical communication with a first phase, and a second set of rods (comprising another two or more of rods 12) are arranged in electrical communication with another phase. It will be appreciated that the control of the electrical association of the members is complex and generally well known in the art, and will not be explored further hereafter.

The region 24 is shaped so as to direct or focus a quantity ions received thereby toward the desired pathway P. For the arrangement shown, the pathway P is substantially concentric with the common axis X.

Figure 2:
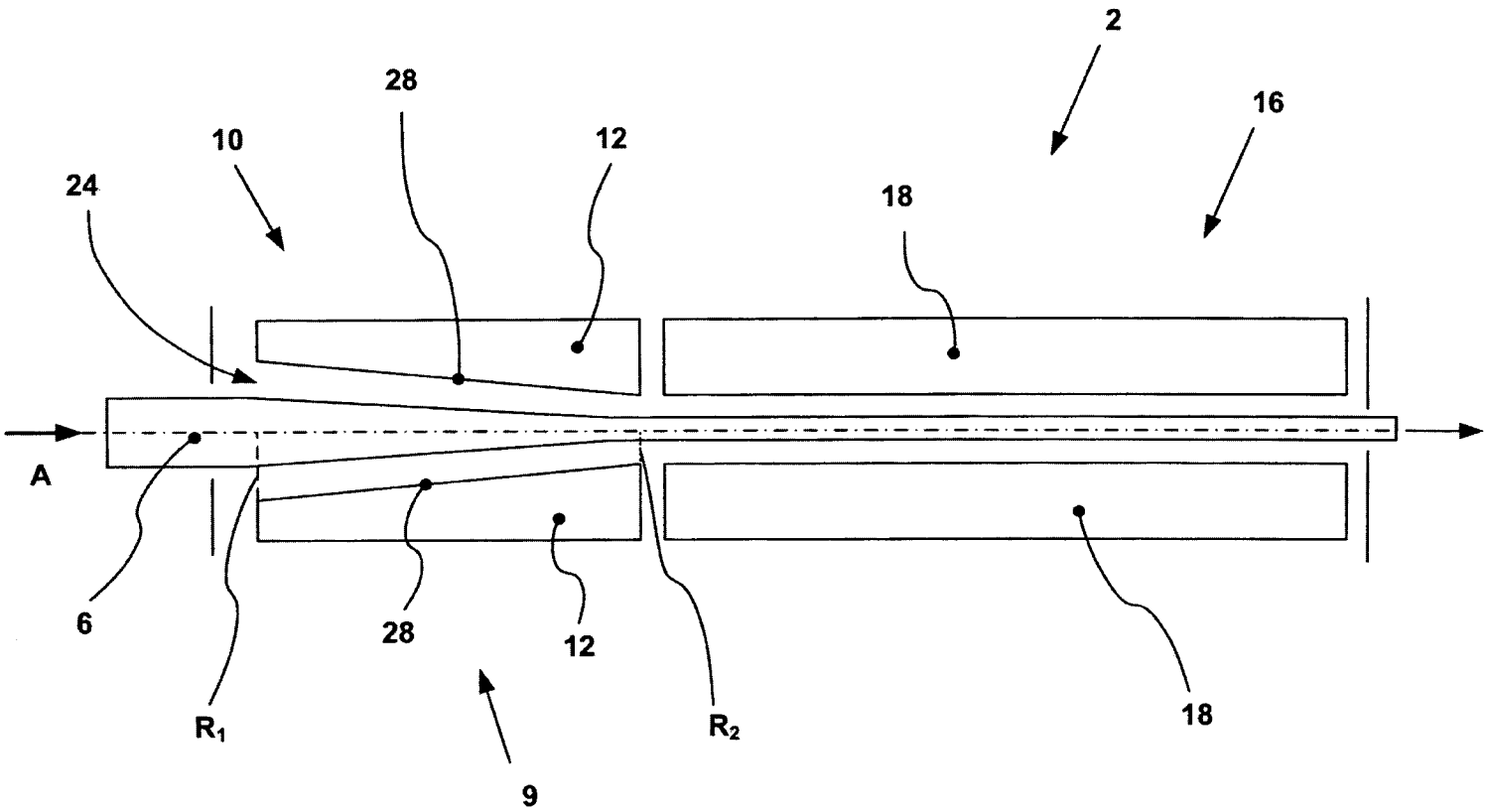
FIG. 2 shows a cross section of the embodiment shown in FIG. 1.

FIG. 2 shows a cross section of the ion guide arrangement shown in FIG. 1. The region 24 is arranged and orientated so that ions are received at an end thereof having a dimension $R_1$ (an effective radius measured from the common axis X to the effective periphery of the region 24), and flow toward an end opposite thereto having a dimension ($R_2$) relatively smaller than $R_1$. As the convergence in the example is linear, the dimension (for example the effective radius) of the region 24 changes (reduces) continuously as a function of distance along the common axis X in the direction A of the ion flow.

The ends of the rods 12 are arranged such that their respective cross-sections taper. In this way, the cross-section of the rods 12 continuously changes (in a linear manner) along that part of its length. Thus, as shown, the shape of interior facing portions of the rods 12 (those portions of the rods which face inwards towards the common axis X) is such that their respective ends are tapered (longitudinally relative to the axial direction of the respective elongate member). This has the ultimate effect of providing a truncating portion of the ends as is clearly shown. This truncation provides a modified surface region 28 at the ends of the rods 12 which is substantially flat. It will be appreciated, however, that the modified surface region 28 may be shaped so as to be concave or convex, or any other surface shaping as is desired and appropriate to the circumstance at hand. Other modifications to the cross-section of the rods 12 are envisaged within the scope of the invention.

It will be appreciated that, for various embodiments of the invention, it is the inner faces of the rods which are modified in accordance with the invention. Furthermore, the modified cross-section may result in convergence of the inner faces of the rods. It may also result in divergence of the inner faces (discussed further below).

Embodiments of the configuration shown are thought to allow the ions to accelerate toward pathway P and therefore allow for more efficient transport of the ions through the ion guide arrangement 2 even if increased gas pressure is provided (for increasing the efficiency of collisional reactions). Such arrangements are considered to have the effect of improving ion mobility through the mass spectrometry device thereby improving the ultimate signal intensity.

The ion guide arrangement 2 further comprises a mass filter assembly 16 comprising four further elongate rods 18 spaced also about the common axis X.

Preferably, ion guide and mass filter assemblies are held in position by a support assembly (refer items 54 and 56 shown in FIG. 3 and FIG. 5 respectively) comprising one or more support members arranged so as to ensure the ion guide and mass filter assemblies are positioned appropriately relative to the surrounding components, such as those typical of mass spectrometer devices. The general configuration and supporting structure of the rods 12 will be known in the art and further description is therefore not required, however, one advantage of the arrangement of the present invention is that customized supporting assemblies do not need to be designed or developed to accommodate inferior arrangements where the elongate members are each arranged in different orientations. The specific and individual shaping of the rods 12 which serve to define the region 24 (which receives the ions) allow the elongate members to be held within existing or standard support assembly arrangements.

It will therefore be appreciated that the end 9 of the guide assembly 10 is sufficiently shaped so that the rods 12 define, at least in part, the periphery of the region 24 so that the ions (6) may be received and focused toward pathway P. This has been found to have an advantageous effect of increasing the quality of the ion stream which passes through the ion guide arrangement 2 thereby serving to improve the signal sensitivity of the ion stream at the mass detector (not shown).

Figure 3:
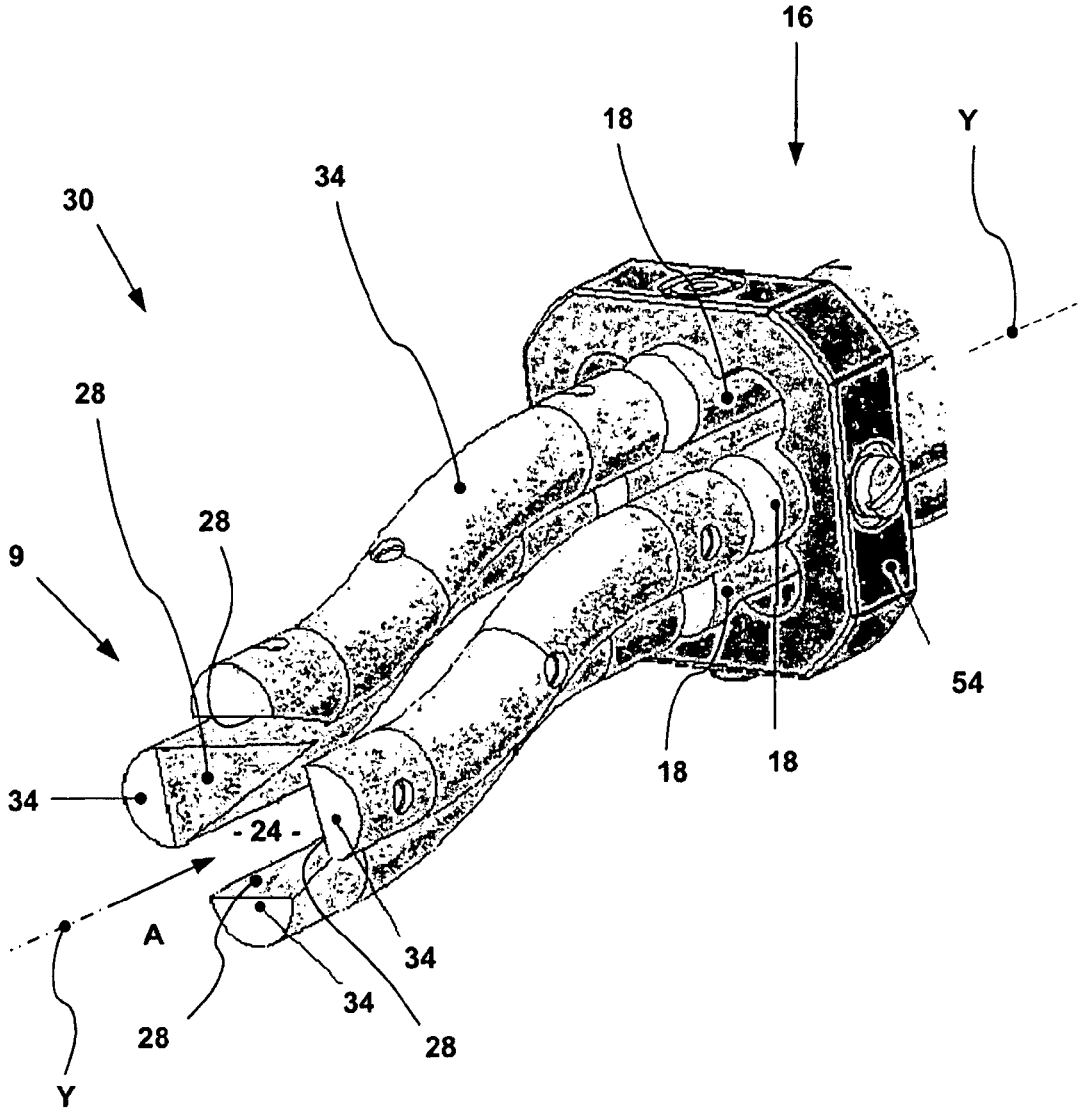
FIG. 3 shows a perspective view of an ion guide arrangement arranged in accordance with another embodiment of the present invention.
Figure 4:
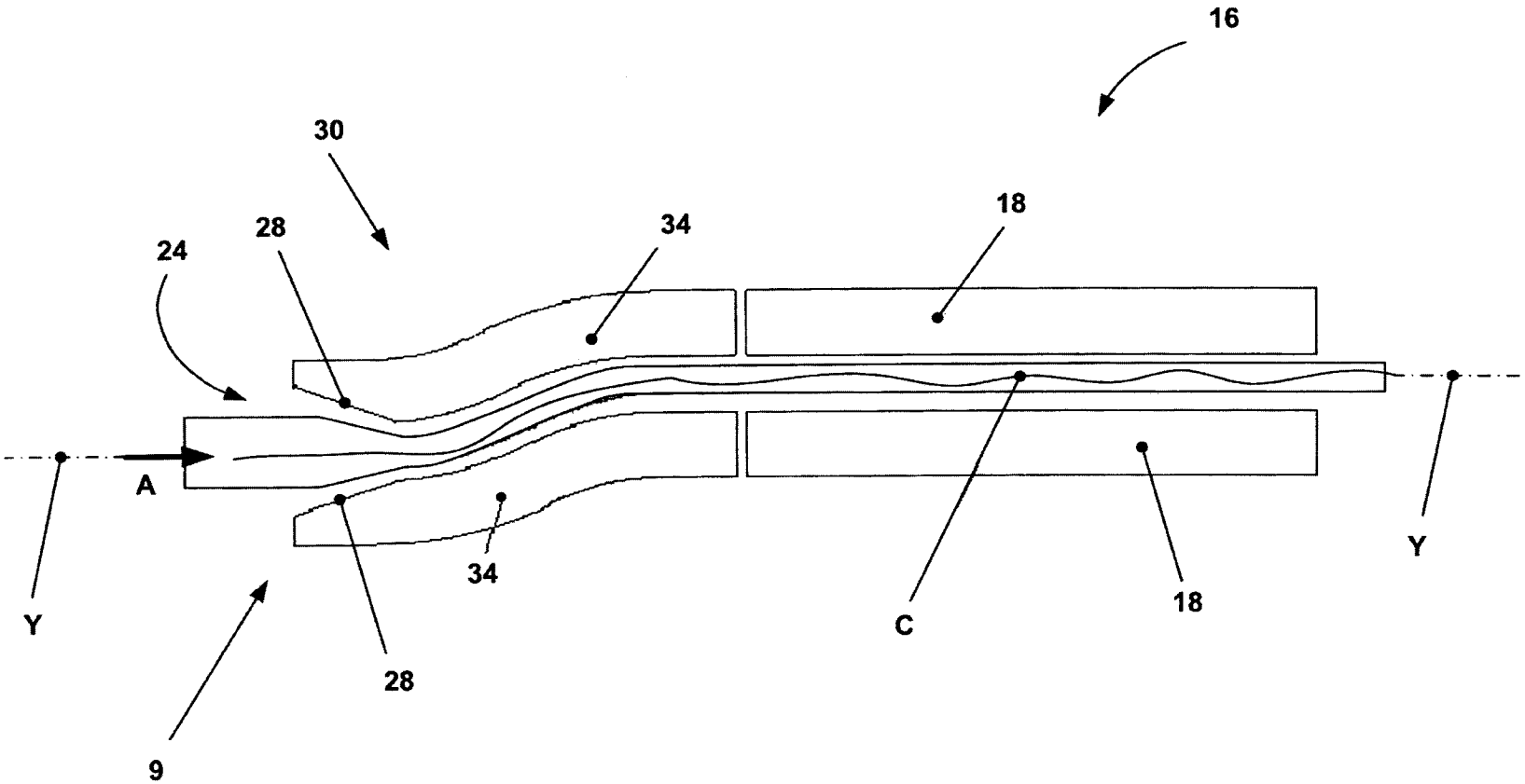
FIG. 4 shows a cross section of the embodiment shown in FIG. 3.

FIGS. 3 and 4 show a further embodiment of an ion guide arrangement 30 arranged in accordance with the present invention having four elongate but curved members 34 spaced in parallel relationship about curvilinear axis Y. As shown in FIG. 4, each of the elongate members 34 are shaped so that pathway C substantially accords with the axial shape of the members 34.

With reference to FIGS. 5, 6, 8, and 9, ion guide arrangements provided in accordance with the present invention may be arranged for use in collisional or reaction cells (hereinafter collisional cells). Collision cells typically hold one or more pressurized gases such as ammonia, methane, oxygen, nitrogen, argon, neon, krypton, xenon, helium or hydrogen which reacts with the ions as an additional means of eliminating unwanted residual interfering particles.

Collisional cells may be arranged to either hold one of the gases or a combination of two or more. Collisional cells may also be arranged so that the pressures of the gaseous atmosphere can be increased so as to increase the filtering of the ion stream. It will be appreciated that the latter mentioned gases are by no means exhaustive and that many other gases, or combinations thereof, may be suitable for use in such collision cells.

Figure 5:
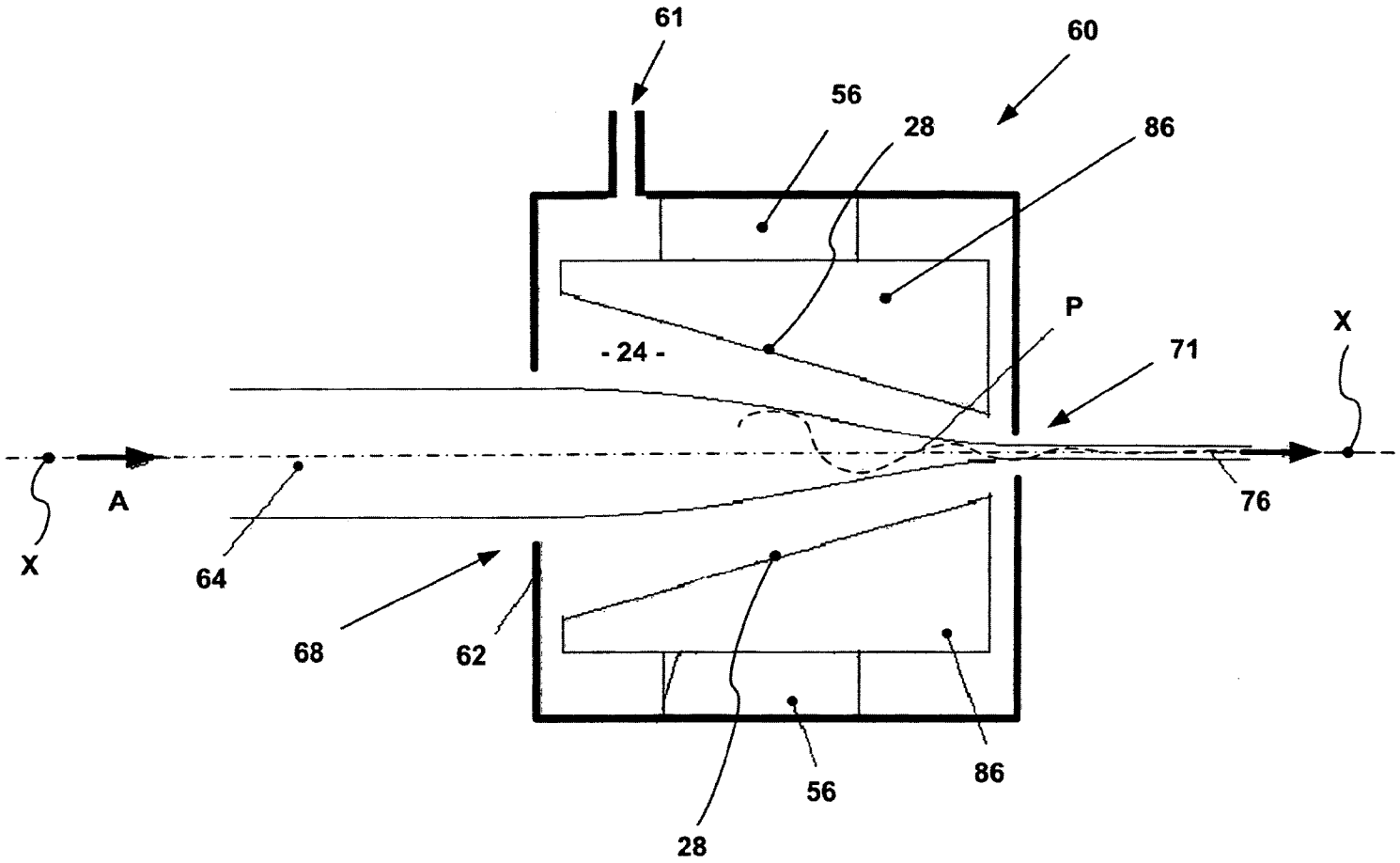
FIG. 5 shows a schematic view of an embodiment of a collisional cell arranged having an ion guide arrangement arranged in accordance with an embodiment of the present invention.
Figure 6:
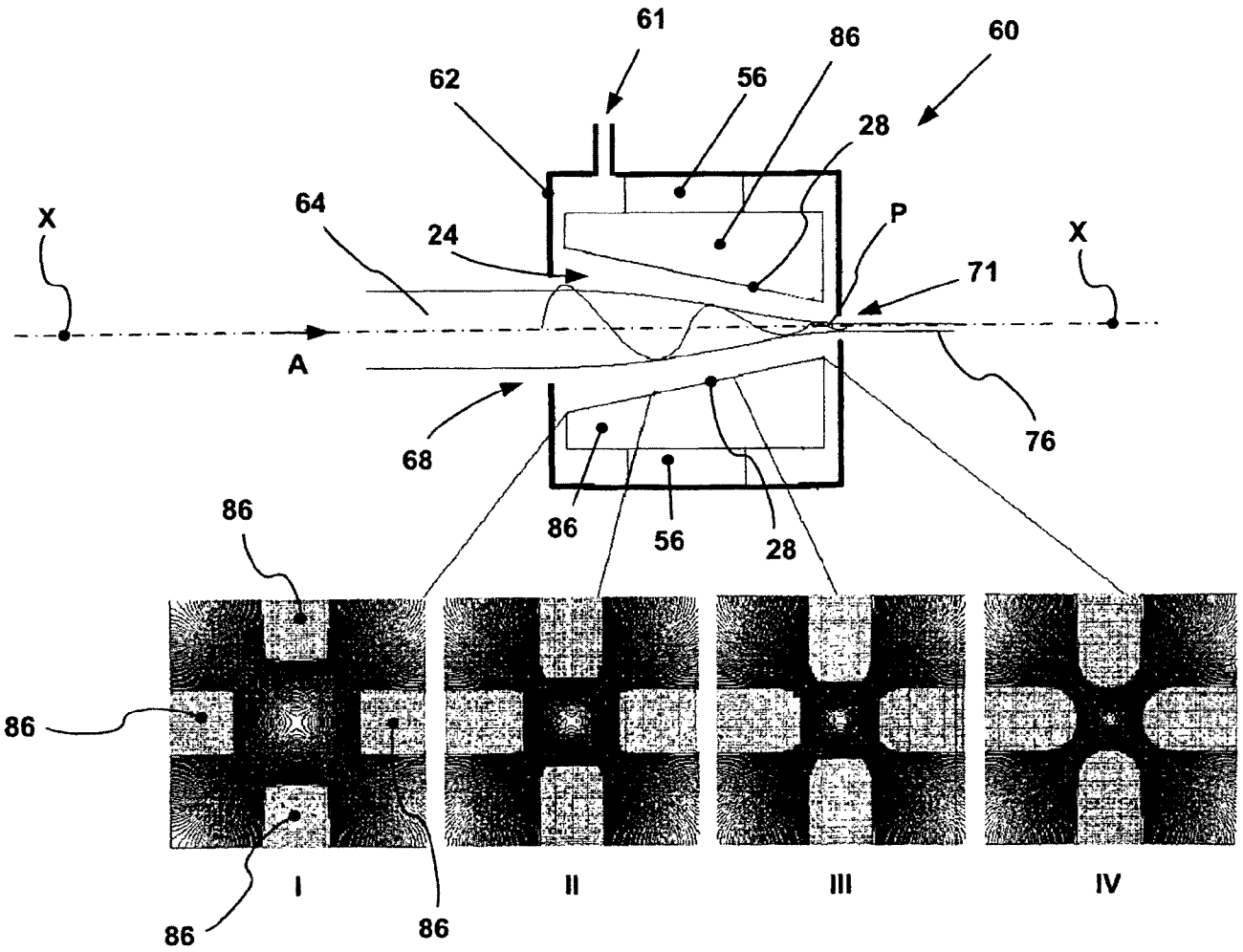
FIG. 6 shows a schematic view of the embodiment of the collisional cell shown in FIG. 5, further showing a number of ion density cross sections taken at selected points along the entry region of the ion guide arrangement.

FIGS. 5 and 6 show a collisional cell arrangement 60 having a simplified ion guide arrangement comprising elongate members 86 which are spaced about common axis X. The ion guide arrangement shown takes many of the features of the embodiments described and shown in FIGS. 1 to 4. Accordingly, where appropriate, corresponding reference numerals are retained.

When embodied in a collisional cell, the shaping of the elongate members 86 which define the converging region 24, is thought to have the effect of repelling any by-product ions generated due to chemical/physical reactions occurring within the first region.

The collisional cell arrangement 60 comprises a housing 62 which is arranged so as to be substantially airtight so that it may contain an atmosphere comprising one or more predetermined collisional gases. Furthermore, the housing is arranged so that the internal pressure may be monitored and controlled.

The housing 62 comprises a gas inlet 61 through which the gases may be introduced into the collisional cell arrangement 60. The housing 62 also includes an outlet (not shown) through which the gases can be exhausted so as the internal atmosphere may be replenished or modified.

The housing 62 comprises an ion inlet 68 through which ions 64 may be introduced into the region 24. The housing 62 further comprises an ion outlet 71 through which ions pass from the region 24, and from which the ions exit (76) the collisional cell arrangement 60. The ion inlet 68 and ion outlet 71 are shown each concentric about the common axis X.

The ion inlet 68 and ion outlet 71 of the housing 62 each exist in the form of respective apertures provided in the housing and, in one form, are provided on opposite walls of the housing 62.

Figure 7:
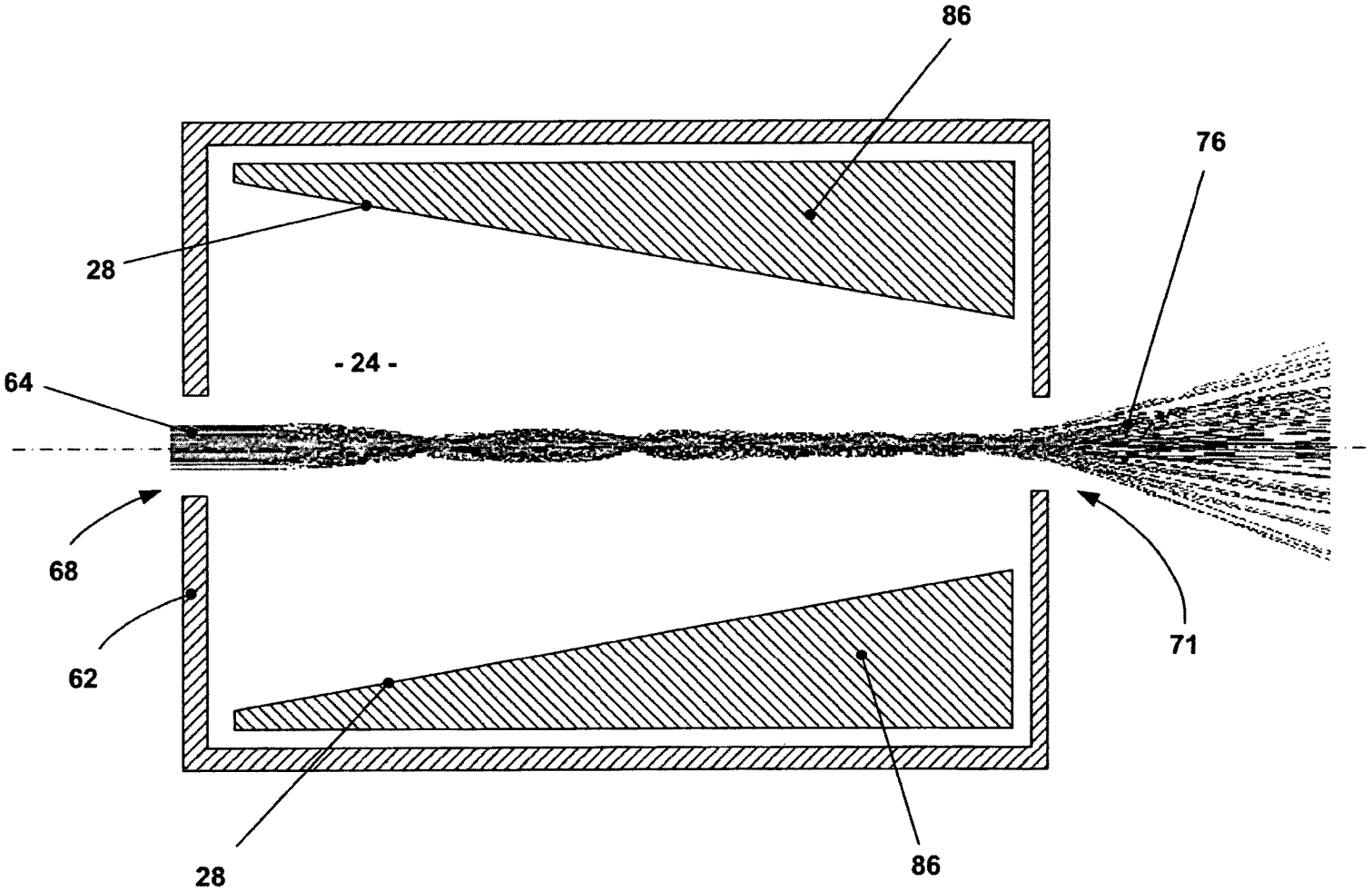
FIG. 7 shows an example of a computer simulation showing the likely ion stream now through the embodiments presented in FIGS. 5 and 6.

FIG. 6 shows four ion density plots (simulated using computer modeling techniques) representing transverse sections at discrete sections (denoted as I, II, III, IV in FIG. 6) along the common axis X of the region 24. It will be clearly seen that the ion density field is predicted to reduce as the region 24 converges towards common axis X. FIG. 7 shows a simulation of the predicted flow pattern of the ion stream flowing through the ion guide within the collisional cell.

Figure 8:
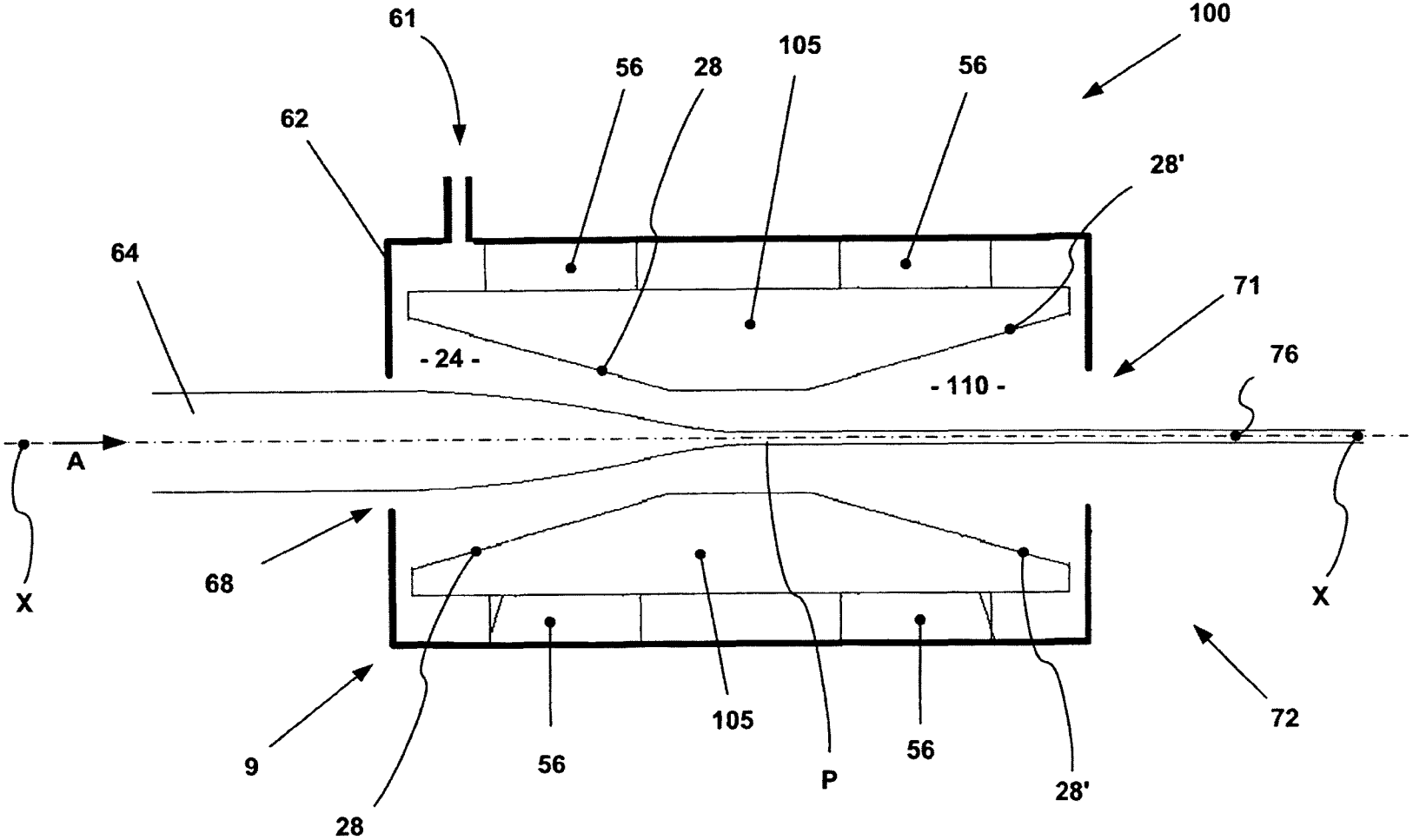
FIG. 8 shows a schematic view of a cross section of a further embodiment of a collisional cell arranged having an ion guide arrangement arranged in accordance with another embodiment of the present invention.

A further collisional cell arrangement 100 is shown in FIG. 8 in which a second region 110 is provided at a second end 72 of the ion guide assembly (opposite the first end 9), and from which the ions exit from the ion guide arrangement. Elongate members 105 are arranged so as to define pathway P between the first 24 and second 110 regions. The elongate members 105 are thus shaped at opposite ends thereof so as the first region 24 substantially converges towards the common axis X (in the ion flow direction A), and the second region 110 substantially diverges from the common axis X (also in the ion flow direction A). It will be noted that the truncation of the elongate members 105 at the end which defines the second region 110 provides modified surface regions 28'. Embodiments of this ion guide arrangement are considered helpful when it is desired to promote or enhance the transport efficiency of the ion flow when exiting the ion guide arrangement. Thus, arrangements of this nature have been found to improve the mobility of ions throughout mass spectrometry devices thereby improving the signal intensity.

Figure 9:
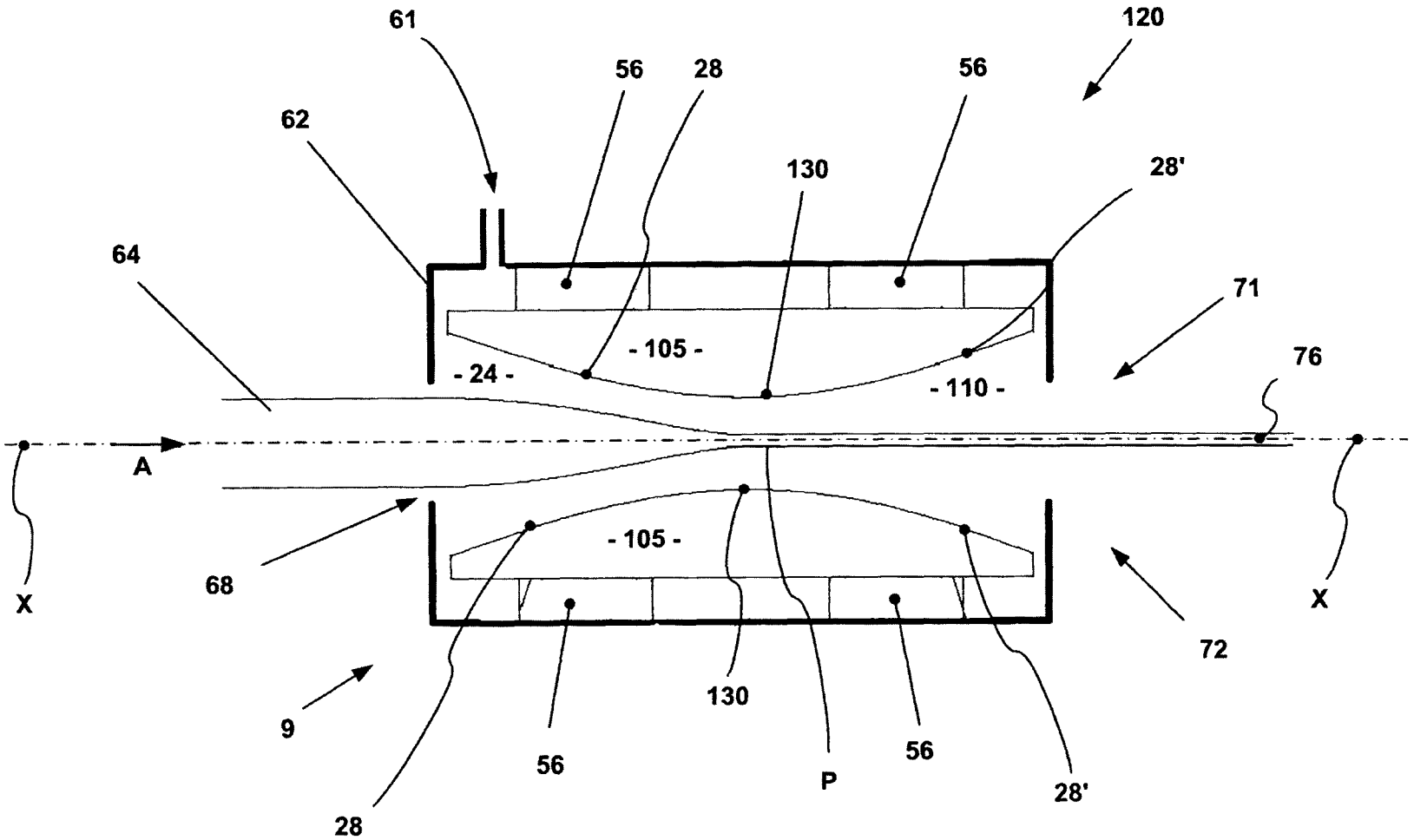
FIG. 9 shows a schematic view of a cross section of a variation of the arrangement shown in FIG. 8.
Figure 10:
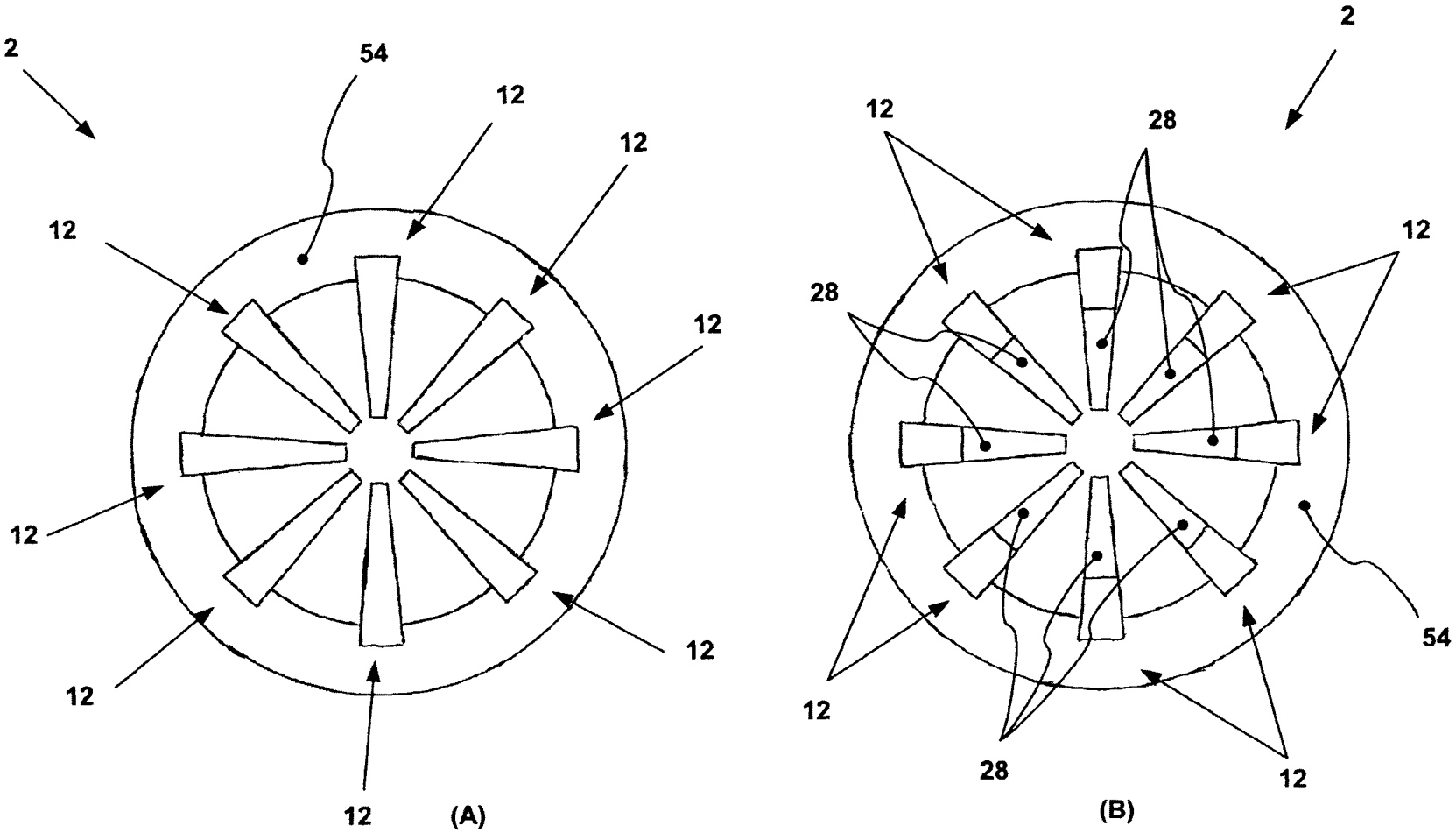
FIG. 10A shows an end view of a further embodiment arranged in accordance with the present invention when viewed along the axis of the ion flow looking upstream from where the ion flow exits the arrangement.
FIG. 10B shows an end view of the entrance region of the embodiment shown in FIG. 10A when looking downstream of the ion flow.

FIG. 9 shows a further collisional cell arrangement 120 comprising substantially the same features as that described for the embodiment shown in FIG. 8, however, it will be clearly seen that the elongate members 105 are provided with a curved shaping 130 arranged so as to define regions 24 and 110.

It will be appreciated that ion guide arrangements where the ion, entry and exit regions are spatially distinct from one another (arrangements employing curved elongate members) may also be employed for use in collisional cells. Thus, for embodiments where the first 24 and second 110 regions are spatially distinct from one another, the ion inlet 68 will be provided in the appropriate wall of the housing 62 so that ions may be received by the first region 24, and the ion outlet 71 will be provided so that the ions may pass from the second region 110 and outward therethrough. Thus, it will be appreciated that the ion inlet 68 will be generally concentric with the first region 24, and the ion outlet 71 will be generally concentric with the second region 110.

Figure 11:
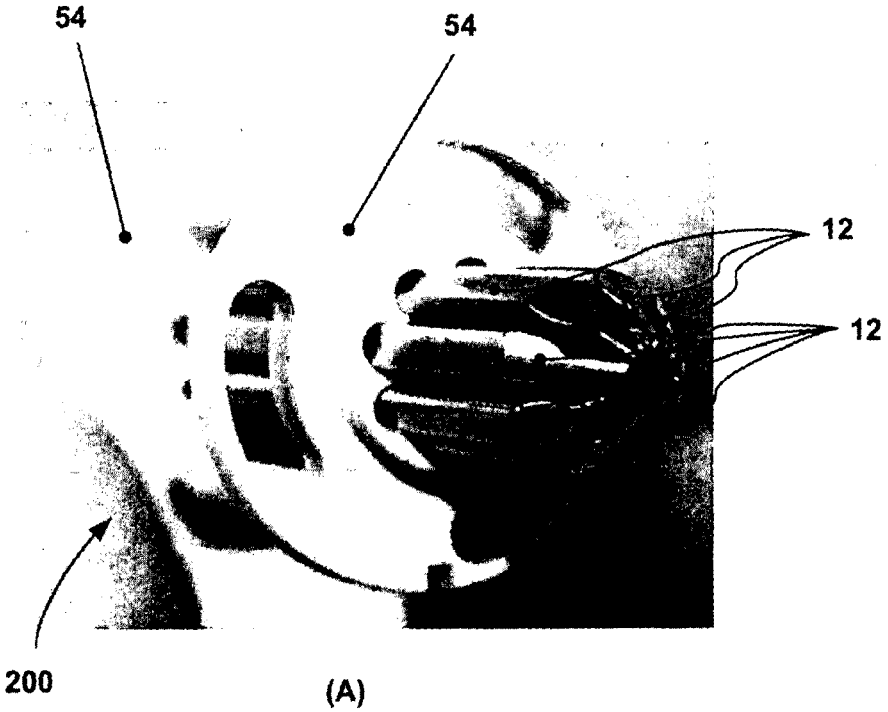
FIG. 11A shows a perspective view of an existing ion guide arrangement capable of being modified so as to exhibit an arrangement according to the present invention.
FIG. 11B shows a further perspective view of the ion guide arrangement shown in FIG. 11A.
Figure 11:
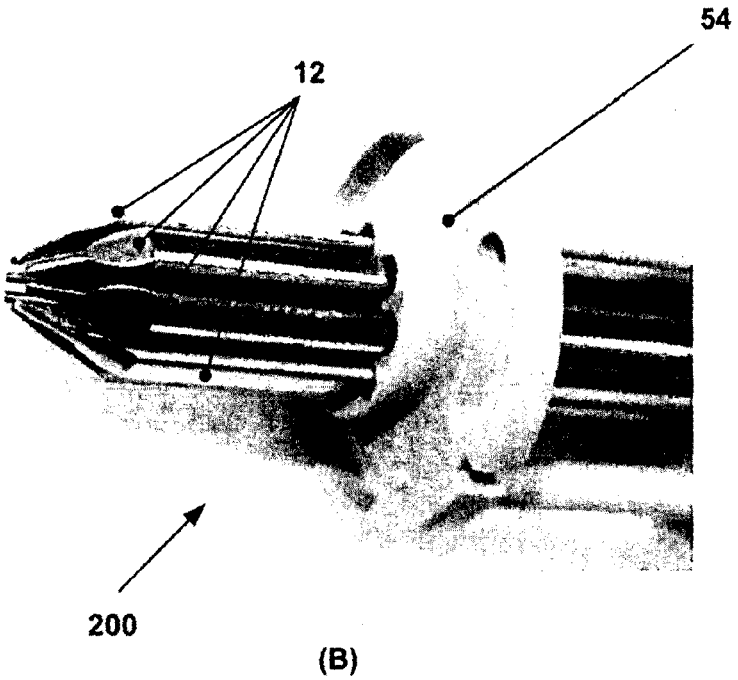

It will be appreciated that one advantage of the present invention is that existing ion guide arrangements may be appropriately modified so as to take advantage of the present invention. With reference to FIGS. 11A and 11B, an existing ion guide arrangement 200 is shown (the reference numerals of the rods 12 and associated support assemblies (54) are retained to ensure consistency with the previous discussion).

In the simplest case, each of the rods 12 may be modified as appropriate so that they exhibit the modified cross-section along an inner part of their respective lengths. Thus, it will be appreciated that an existing ion guide arrangement may be appropriately configured by modification of the rods 12 so that their cross-sections substantially accord with any of the embodiments described herein and shown in the accompanying Figures. As such, it will be appreciated that, for the most part, only the rods 12 themselves need to be modified thereby avoiding the need for fabricating customized supporting assemblies (or indeed modifying existing supporting assemblies). In this regard, the substance of the present invention can be readily applied to existing ion guide arrangements.

The modification of the or each such elongate member(s) can be effected by appropriate precision machining techniques and equipment as will be well known in the art in order to benefit from the principles of the present invention.

The word 'comprising' and forms of the word 'comprising' as used in this description and in the claims does not limit the invention claimed to exclude any variants or additions. Modifications and improvements to the invention will be readily apparent to those skilled in the art. Such modifications and improvements are intended to be within the scope of this invention.

The claims defining the invention are as follows:

1. An ion guide assembly having a plurality of elongate rods oriented about a common axis, the elongate rods capable of being in electrical association with one another so as to guide a stream of ions along an intended pathway substantially aligned with the common axis, each elongate rod having a cross-section that increases in a direction of ion travel along part of its length in a region adjacent the common axis.

2. An ion guide assembly according to claim 1, wherein the cross-section so modified substantially faces the common axis.

3. An ion guide assembly according to claim 1 wherein the modification is such so that the cross-section substantially tapers toward a free end of the respective elongate rod.

4. An ion guide assembly according to claim 1 wherein the modification is such so that the cross-section presents a concavity or convexity facing toward the common axis.

5. A collisional cell comprising an ion guide assembly according to claim 1.

6. A mass spectrometer having an ion source for producing a directed ion beam along a desired pathway, detection means, and at least one collisional cell according to claim 5.

7. A mass spectrometer having an ion source for producing a directed ion beam along a desired pathway, detection means, and at least one ion guide assembly according to claim 1.

8. An ion guide arrangement comprising;

an ion guide assembly comprising:

a plurality of elongate members arranged so as to be spaced about a common axis, each of the elongate members capable of being in electrical association with one another so as to guide a stream of ions along an intended pathway substantially aligned with the common axis, the or each elongate member shaped at or near an end of the ion guide assembly so as to, at least in part, define a region capable of receiving a quantity of ions, the or each elongate member so shaped so that the region converges substantially toward the axis in a direction aligned substantially with the flow of ions along the pathway.

9. An ion guide arrangement according to claim 8, wherein the region is shaped so as to direct or focus a quantity ions received thereby toward the pathway.

10. An ion guide arrangement according to claim 8 wherein a dimension of the region is larger at the end of the guide assembly where the ions are initially received, and smaller at an end opposite thereto.

11. An ion guide arrangement according to claim 8 wherein a dimension of the region changes continuously as a function of the distance along the common axis in the direction of the ion flow.

12. An ion guide arrangement according to claim 8 wherein the shape of the ends of the elongate members is such that the periphery of the region converges towards the common axis in a substantially linear manner.

13. An ion guide arrangement according to claim 8 wherein the shape of the interior facing portion of the or each elongate member is such so that the end of each elongate member is tapered.

14. An ion guide arrangement according to claim 8 wherein the shape of each elongate member is in the form of a truncation or similar formation.

15. An ion guide arrangement according to claim 14, wherein the truncated shape provides a modified surface region at the end of each respective elongate member such that said surface region is substantially flat.

16. An ion guide arrangement according to claim 8 having an exit which coincides with the termination of the intended pathway along which the ions flow.

17. An ion guide arrangement according to claim 8 wherein the guide assembly is held in position by a support assembly comprising one or more support members arranged so as to ensure the guide assembly is positioned appropriately relative to the surrounding components, such as those typical of mass spectrometer devices.

18. An ion guide arrangement comprising:

an ion guide assembly comprising:

a plurality of elongate members arranged so as to be spaced about a common axis, the elongate members capable of being in electrical association with one another so as to guide a stream of ions along an intended pathway substantially aligned with the axis, the or each elongate member shaped at or near a first end of the ion guide assembly so as to define, at least in part, a first region capable of receiving a quantity of ions;

a second region defined, at least in part, by the elongate members at a second end of the ion guide assembly, opposite the first end, and from which the ions exit from the ion guide arrangement, the elongate members are arranged so as to define a pathway between the first and second regions;

the or each elongate member so shaped at the respective ends so as the first region substantially converges towards the axis, and the second region substantially diverges from the axis in a direction aligned substantially with the flow of ions along the pathway.

19. An ion guide arrangement according to claim 18, wherein the shape of the second region is such that an end from which ions exit the ion guide assembly is larger in dimension than an opposite end at which ions are received from the first region.

20. An ion guide arrangement according to claim 18 wherein the first and second regions are spatially distinct from each other.

21. An ion guide assembly having a plurality of elongate rods oriented about a common axis, the elongate rods capable of being in electrical association with one another so as to guide a stream of ions along an intended pathway substantially aligned with the common axis, the inwardly facing surface of each elongate rod having been modified such that the distance of said surface from the common axis decreases in a direction of ion travel along part of its length relative to the intended ion pathway.

* * * * *